United States Patent [19]

Helton et al.

[11] 3,932,952

[45] Jan. 20, 1976

[54] MULTI-MATERIAL RIPPER TIP

[75] Inventors: Eugene L. Helton, Peoria; Walter B. Miller, Pekin, both of Ill.

[73] Assignee: Caterpillar Tractor Co., Peoria, Ill.

[22] Filed: Dec. 17, 1973

[21] Appl. No.: 425,191

[52] U.S. Cl. ..... 37/142 R; 175/374; 175/410; 172/747

[51] Int. Cl.[2] ..... E02F 9/28

[58] Field of Search ..... 37/141 R, 142 R, 142 A; 172/699, 713, 719, 745, 747; 76/101 A, DIG. 11; 29/470.3; 175/410–412, 374

[56] References Cited

UNITED STATES PATENTS

| | | | |
|---|---|---|---|
| 215,840 | 5/1879 | Taverdon | 76/DIG. 11 |
| 645,617 | 3/1900 | Boxley | 76/101 A |
| 2,474,643 | 6/1949 | Webb | 76/101 A |
| 3,080,009 | 3/1963 | Baker | 175/410 |
| 3,356,418 | 12/1967 | Healey et al. | 175/410 X |
| 3,529,677 | 9/1970 | Stephenson | 172/747 X |
| 3,599,737 | 8/1971 | Fischer | 175/410 X |
| 3,693,736 | 9/1972 | Gardner | 175/410 |
| 3,737,199 | 6/1973 | Stephenson | 37/142 R X |
| 3,768,147 | 10/1973 | Berry et al. | 29/470.3 |
| 3,805,423 | 4/1974 | Engel | 37/142 R |

OTHER PUBLICATIONS

"Brazing Manual" American Welding Society pp. 232–236; 1963.

*Primary Examiner*—E. H. Eickholt
*Attorney, Agent, or Firm*—Phillips, Moore, Weissenberger Lempio & Strabala

[57] ABSTRACT

A multi-material earthworking ripper tip having a leading nose portion comprised of a material having greater wear resistance and strength at elevated temperatures than the material which comprises the rearward shank supporting portion of the tip. In one embodiment, a bi-metallic nose portion is inertial welded to the shank support portion of the tip. In another embodiment powdered tungsten carbide is sintered in situ within a hollow bore of a steel nose portion. Alternately, a solid core of tungsten carbide could be soldered, brazed or press fitted within said hollow bore.

1 Claim, 6 Drawing Figures

Fig. 4.
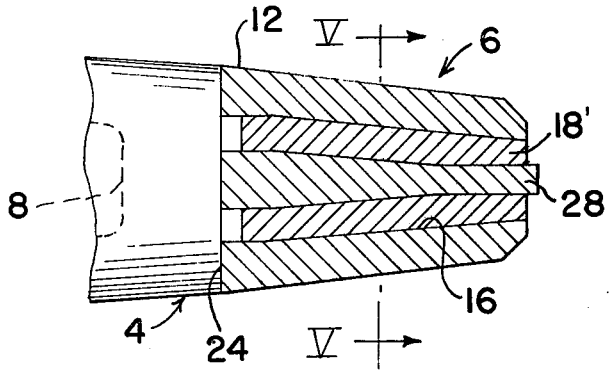
Fig. 5.
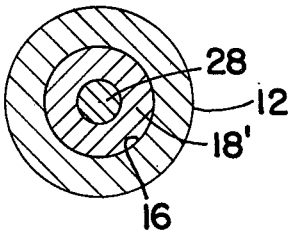
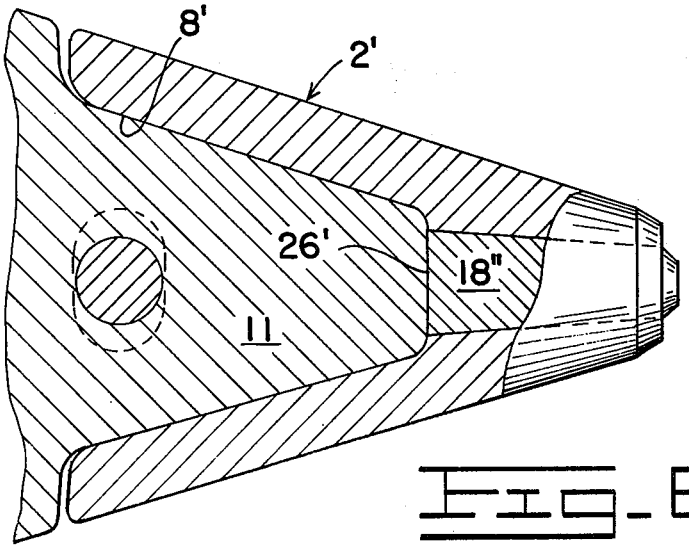
Fig. 6.

MULTI-MATERIAL RIPPER TIP

BACKGROUND OF THE INVENTION

Ground engaging ripper tips for earthmoving apparatus must be chosen in accordance with the particular job requirements in the interest of economy. High quality ripper tips made from expensive, highly wear resistant material are unnecessary and unduly expensive when ripping soft materials. However, soft or low resistance ripper tips utilized in hard ground applications would be destroyed rapidly, particularly at the extremely high friction temperatures encountered when such tips are used in connection with a high powered earthmover vehicle in a hard ground application.

In such a case, it is essential that the tips used exhibit good heat treatment characteristics, high strength, toughness and wear resistance at elevated temperatures, frequently as high as 1000°F.

It is noted, however, that only the leading end or nose portion of the ripper tip which is directly exposed to the material being ripped reaches such elevated temperatures. The use, therefore, of expensive hard and wear resistant material for the entire tip would be uneconomical. In order to provide a tip having both the requisite high temperature wear requirements on the nose thereof and a tip which is economical to use and replace, multi-metallic fabrications have been utilized, with a leading portion of special hardened material for greater wear and strength and the remaining portions of softer, less resistant material.

Examples of prior art attempts to provide multimetallic ripper tips and general purpose tooth members are found in U.S. Pat. Nos. 2,718,162 to Smith; 2,738,602 to Meeks; 2,739,395 to Stratton; 2,837,843 to Meshorer; 3,280,486 to Hackel; 3,309,801 to Ratkowski; and 3,453,756 to Schroeder.

SUMMARY AND OBJECTS OF THE INVENTION

The instant invention provides a multi-material ripper tip for earthmoving equipment which includes a rearward disposed supporting portion adapted for engagement with a shank member of the earthworking equipment and having a leading nose portion inertia welded to the supporting portion wherein the nose portion is hollow and contains a conical core of special hardened material. In one instance the hollow nose portion may be made of a material having different properties from those of the supporting portion. Both the nose portion and the supporting portion may be made of the same material if desired. The hardened special material centrally located within the nose portion may be disposed therein in solid form or may be placed therein in powdered form and sintered in situ.

One of the objects of the present invention is to provide a wedge shaped or conically shaped ground engaging tip having a shank engaging support portion and a leading nose portion wherein the nose portion contains a core of material of greater hardness than that of the support portion.

Another object of the percent invention is to provide a multi-material ground engaging ripper tip having a nose portion comprised of a material having greater wear resistance at high temperatures than the shank engaging support portion thereof.

A further object of the present invention is to provide a wedge shaped or conically shaped ground engaging tip having a ground engaging core portion which is made of tungsten carbide placed within a nose portion in powdered form and sintered in situ.

A still further object of the present invention is to provide a multi-material ground engaging tip having a shank engaging support portion and a nose portion wherein the nose portion is welded by means of inertia welding to the shank engaging portion.

Another object of the present invention is to provide a multi-material ground engaging tip having a nose portion which has a tapered bore machined therein which bore conforms substantially with the external shape of the nose portion.

Yet another object of the present invention is to provide a multi-material ground engaging tip having a nose portion with a core receiving bore therein which bore converges in the direction of the tip of the nose portion.

Still another object of the present invention is to provide a multi-material ground engaging tip having a shank engaging support portion and a nose portion wherein the nose portion is attached by inertia welding to the support portion and wherein a tapered bore transpierces both the support portion and the nose portion and wherein a hardened material core is disposed within such tapered bore in abutting relation to the leading surface of the shank which supports the tip.

Other objects and advantages of the present invention will become apparent from the following description and drawings.

BRIEF DESCRIPTION OF THE DRAWINGS

FIG. 4 is a partially cutaway enlarged sectional elevation of an alternate multi-material ripper tip;

FIG. 5 is a sectional view taken along the line V—V of FIG. 4; and

FIG. 6 is a sectional view of a modified form of the present invention.

DETAILED DESCRIPTION

Figure 1:
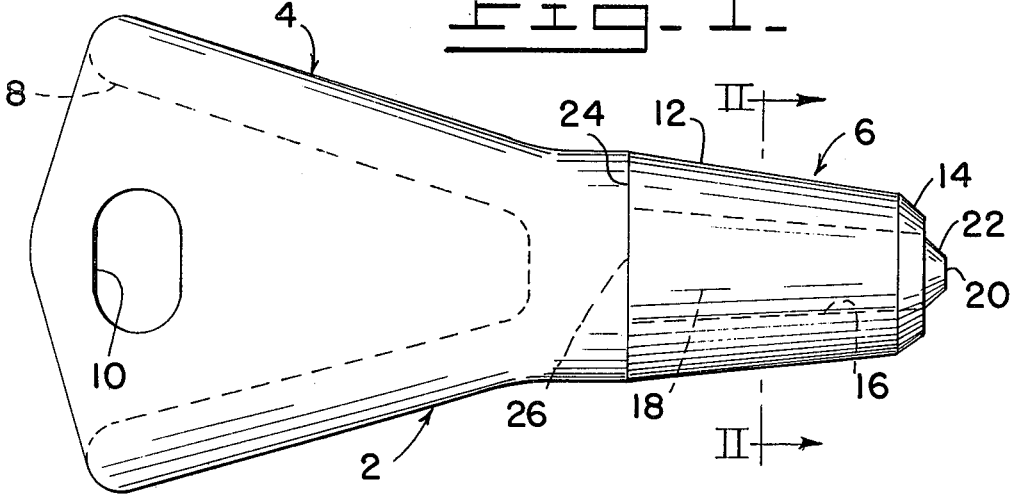
FIG. 1 is an elevation of a multi-material ripper tip in accordance with the present invention.
Figure 2:
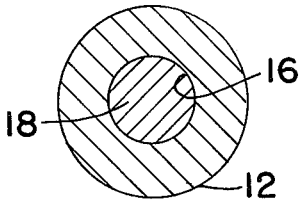
FIG. 2 is a sectional view taken along line II—II of FIG. 1.
Figure 3:
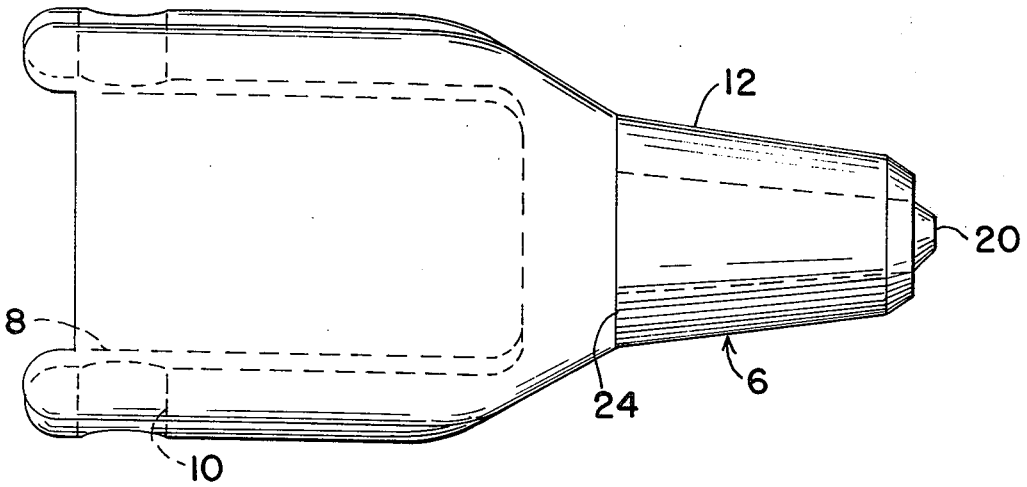
FIG. 3 is a plan view of the multi-material ripper tip shown in FIG. 1.

With reference to FIG. 1 of the drawings, the instant multi-material ripper tip is shown generally at 2. The ripper tip has a shank receiving support portion 4 and a leading nose portion 6. The support portion has a wedge shaped internal socket 8 for receiving a comparably shaped shank member of the earthworking machine to which the tip is adapted. The precise shape of the internal socket will be fully appreciated with additional reference to the plan view shown in FIG. 3. The support portion is conveniently provided with a pin receiving aperture 10 for connection of the tip to the shank (not shown).

The nose portion is generally conically shaped and has a first conical hollow element 12 with a tapered external surface and a stepped down more abruptly tapered surface 14. The nose portion is also provided with a distally converging conical bore 16 having substantially the same taper as the external surface of the element 12. Within the tapered bore 16 is disposed a core 18 comprised of a special wear resistant, hard material such as tungsten carbide or the like which is retained in place by means of silver soldering, brazing, or press fitting. The core 18 is preferably provided with a tapered tip surface 22 and end portion 20 for enhanced penetration capability. The element 12 of the nose portion is preferably comprised of a material which, while not as wear resistant as the core 18, has greater wear resistance and strength at elevated temperatures than the support portion 4. Such a nose material might be H-11 tool steel or a comparable alloy while the support portion could be fabricated from a softer, less expensive grade of steel.

The nose portion 6 with the core 18 in position within the bore 16 is friction welded or, more specifically, inertia welded to the support portion 4 of the tip along the juncture 24.

It should be noted that the core 18 is amply supported, by virtue of the special conical configuration of the bore 16, within the nose portion. Such support is extremely important when the core 18 is made from brittle material such as carbide which material tends to fracture and fall out upon impact unless adequately supported.

If desired, the shank receiving socket 8 could extend forwardly to the weld juncture 24. With such an arrangement, the shank would act as an abutment surface for the rearward-most surface 26 of the core 18.

Another variation embodying the shank abutting feature is shown in FIG. 6. In this arrangement, the ripper tip 2' has unitary nose and support portions. The wear resistant core 18'' is retained within a conical bore which communicates with a shank receiving socket 8'. A core surface 26' abuts and is supported by a distal surface of the shank member 11, as shown.

With the present arrangement, those portions of the ripper tip which are most exposed to wear and which must be most durable in high temperature operations are comprised of materials suitable for the purpose whereas the remaining portions of the tip are fabricated from less wear resistant, less expensive materials so that the entire tip wears at an approximately even rate with concomitant maximum economy. In the embodiment shown in FIG. 1, a typical tip would have a tungsten carbide core 18, the external surfaces of the element 12 would be of 86B30 steel, and the support portion 4 would be of any standard tip material.

With reference to FIGS. 4 and 5, a slightly modified version of the inventive multi-material ripper tip may be appreciated. The support portion 4 of the tip may be identical to that shown in FIG. 1 and may, if desired, include a socket 8 which transpierces the entire portion to provide abutting relation between the nose portion components and the shank at the juncture 24, as previously described. In this version, as in the previous embodiment, the nose portion 6 is comprised of a tapered steel cone element 12 which has an approximately correspondingly tapered bore 16 therein. However, instead of a solid tungsten carbide core, the alternate ripper tip is provided with a hollow cone 18' of hard wear resistant material such as tungsten carbide. The hollow interior of the cone 18' tightly contains a steel cone core 28.

The alternate ripper tip is fabricated in a manner which minimizes machining and fitting procedures. The bore 16 of the nose element 12 is first filled with powdered tungsten carbide or similar material in a bonding matrix. Such material is then tightly compressed within the bore by means of the tapered steel cone core 28 which is forced into the bore from the open rear portion thereof adjacent the juncture 24. With the member 28 firmly in place and the material 18' tightly compressed within the bore 16, the nose portion 6 is then heated so as to sinter the powdered material and bonding matrix in situ. Finally, the entire nose portion is preferably inertial welded at 24 to support portion 4.

As in the previously described embodiment, the brittle tungsten carbide material is well supported within the bore 16 by the element 12. However, in the embodiment of FIG. 4, the material is also supported centrally by means of the steel cone core 28. This prevents the carbide material from separating due to wear, impact or the like.

While the invention has been described with particular reference to the preferred embodiments, it is apparent that variations and modifications are possible within the purview of the inventive concepts. No limitation with respect to such variations and modifications is intended, except by the scope of the appended claims.

We claim:

1. A multi-material earthworking ripper tip for mounting upon a shank member of an earthworking device comprising; support means for mounting said tip upon said shank member, said support means including an internally formemd socket adapted to engage said shank member, separate tapered nose means attached to said support means, said nose means including a nose member having a first external portion, said first external portion being conical and having a taper diverging toward said support means, said nose member also having a uniformly tapered centrally disposed bore therein continuously diverging toward said support means, core means disposed within said central continuously diverging tapered bore and extending therein from a first end of said nose member proximate said support means to a second distal end of said nose member, said core means being comprised of material which is harder and more wear resistant than that of said support means, said core means including a tapered hollow cone member mounted within said centrally disposed bore and having an axially disposed second bore therein, said core means further including a core member being comprised of tungsten carbide material sintered in situ within said tapered centrally disposed bore, said core member being tapered and having an external surface diverging toward said support means.

* * * * *

UNITED STATES PATENT AND TRADEMARK OFFICE

CERTIFICATE OF CORRECTION

PATENT NO. : 3,932,952

DATED : January 20, 1976

INVENTOR(S) : Eugene L. Helton et al.

It is certified that error appears in the above-identified patent and that said Letters Patent are hereby corrected as shown below:

Claim 1 Line 35 correct spelling of "formemd" to --formed--.

Claim 1 Line 53, after "member" should be inserted --mounted within said second bore, said hollow cone member--.

Signed and Sealed this

Twenty-first Day of December 1976

[SEAL]

*Attest:*

RUTH C. MASON
*Attesting Officer*

C. MARSHALL DANN
*Commissioner of Patents and Trademarks*